US012442546B2

(12) United States Patent
Gray

(10) Patent No.: US 12,442,546 B2
(45) Date of Patent: Oct. 14, 2025

(54) HINGE LOCK MECHANISM FOR WINDOW AIR CONDITIONER

(71) Applicant: Midea Group Co., Ltd., Foshan (CN)

(72) Inventor: Joel M. Gray, Prospect, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 328 days.

(21) Appl. No.: 18/193,944

(22) Filed: Mar. 31, 2023

(65) Prior Publication Data

US 2024/0328640 A1 Oct. 3, 2024

(51) Int. Cl.
*F24F 1/031* (2019.01)
*F24F 13/20* (2006.01)

(52) U.S. Cl.
CPC ..... *F24F 1/031* (2019.02); *F24F 13/20* (2013.01)

(58) Field of Classification Search
CPC ..... F24F 1/031; F24F 13/20; F24F 1/027
USPC ..... 165/47
See application file for complete search history.

(56) References Cited

U.S. PATENT DOCUMENTS

| | | | | |
|---|---|---|---|---|
| 3,271,972 | A | 9/1966 | Knight | |
| 4,407,045 | A | 10/1983 | Boothe | |
| 4,566,150 | A | 1/1986 | Boothe | |
| 5,167,131 | A * | 12/1992 | Karkhanis | F24F 1/027 62/262 |
| 10,401,043 | B2 | 9/2019 | Li | |
| 11,384,945 | B2 | 7/2022 | Aryeh | |
| 11,415,329 | B2 | 8/2022 | Liu et al. | |
| 11,498,163 | B2 | 11/2022 | Li et al. | |
| 11,536,469 | B2 | 12/2022 | Si et al. | |
| 2022/0113040 | A1 | 4/2022 | Liu et al. | |
| 2022/0235948 | A1 * | 7/2022 | Zhou | F24F 1/027 |

FOREIGN PATENT DOCUMENTS

| | | |
|---|---|---|
| CN | 101876467 A | 7/2014 |

* cited by examiner

*Primary Examiner* — Steve S Tanenbaum
(74) *Attorney, Agent, or Firm* — Gray Ice Higdon

(57) ABSTRACT

One or more hinge lock mechanisms for a window air conditioner. The hinge lock mechanism may lock/unlock portions of the window air conditioner in one or more pivot positions. The hinge lock mechanism may include one or more hinge bodies. The hinge lock mechanism may include one or more releasable engagements locking and/or unlocking the hinge bodies relative to each other. The hinge lock mechanism may include a bias mechanism. The hinge lock mechanism may include an actuator.

17 Claims, 15 Drawing Sheets

HINGE LOCK MECHANISM FOR WINDOW AIR CONDITIONER

BACKGROUND

The present embodiments relate to a device and method of locking and/or unlocking a hinged appliance, more specifically a saddle-type window air conditioner.

Typical saddle-type window air conditioners are installed by passing at least the outdoor portion/unit through the window opening and subsequently straddling the outdoor portion/unit and indoor portion/unit relative to the window sill. However, installing such a window air conditioner may be difficult. Thus, there is a need to hinge the outdoor portion relative to at least the indoor portion and/or lock/unlock their relative position to each other.

SUMMARY

In some embodiments, for example, a saddle-type window air conditioner may include an indoor portion. In various embodiments, the conditioner may include an outdoor portion. In some embodiments, the conditioner may include one or more hinge lock mechanisms hingedly pivoting the outdoor portion relative to the indoor portion between a first pivot position and a second pivot position, wherein the second pivot position is different than the first pivot position. In various embodiments, the one or more hinge lock mechanisms may include a locked configuration and an unlock configuration, wherein the one or more hinge lock mechanisms may be in the locked configuration in both the first pivot position and the second pivot position and the one or more hinge lock mechanisms may be in the unlocked configuration between the first pivot position and the second pivot position.

In addition, in some embodiments, the saddle-type window air conditioner may include a connector disposed between the indoor portion and the outdoor portion, wherein the one or more hinge lock mechanisms may hingedly pivot the outdoor portion between the first pivot position and the second position relative to the connector and the indoor portion. In various embodiments, the one or more hinge lock mechanisms may include one or more pins locking a first hinge body to a second hinge body when in locked configuration and unlocking the first hinge body from the second hinge body when in the unlocked configuration. In some embodiments, the one or more hinge lock mechanisms may include an actuator positioning the one or more pins out of engagement with the first hinge body unlocking the first hinge body from the second hinge body. In various embodiments, the one or more hinge lock mechanisms may include a bias mechanism urging the one or more pins and/or the actuator into engagement with the first hinge body locking the first hinge body with the second hinge body. In some embodiments, the one or more hinge lock mechanisms may include a carrier connecting the one or more pins to a hinge pin, wherein the hinge pin connects the first hinge body to the second hinge body. In various embodiments, the conditioner may include at least two of the one or more hinge lock mechanisms. In some embodiments, at least two hinge lock mechanisms may be operated independently of each other to pivot the outdoor portion relative to the indoor portion between the first pivot position and the second pivot position. In various embodiments, at least two hinge lock mechanisms may be operated together to pivot the outdoor portion relative to the indoor portion between the first pivot position and the second pivot position.

In some embodiments, a hinge lock mechanism for a saddle-type window air conditioner may include a hinge pin. In various embodiments, the hinge lock mechanism may include a first hinge body having a first leaf and a first barrel, wherein the first leaf may be configured to connect to an outdoor portion of a saddle-type window air conditioner, wherein the first barrel may include at least one first aperture. In some embodiments, the hinge lock mechanism may include a second hinge body having a second leaf and a second barrel, wherein the second leaf may be configured to connect to an indoor portion of a saddle-type window air conditioner, wherein the second barrel may include at least one second aperture, and wherein the first hinge body may pivot about the hinge pin relative to the second hinge body. In various embodiments, the hinge lock mechanism may include one or more pins positionable between a locked configuration and an unlocked configuration, when in the locked configuration the one of more pins engages at least one first aperture and at least one second aperture to lock the position of the first hinge body relative to the second hinge body and when in the unlocked configuration the one or more pins may be disengaged from at least one first aperture and/or at least one second aperture to unlock the position of the first hinge body relative to the second hinge body.

In addition, in some embodiments, the hinge lock mechanism may include a bias mechanism, wherein the bias mechanism urges the one or more pins towards the locked configuration. In various embodiments, the hinge lock mechanism may include an actuator, wherein the actuator positions the one or more pins from the locked configuration towards the unlocked configuration. In some embodiments, the hinge lock mechanism may include a carrier connecting the one or more pins to the hinge pin. In various embodiments, at least one first aperture may be axially aligned with at least one second aperture when the one or more pins is in the locked configuration, and wherein at least one first aperture may be axially misaligned with at least one second aperture when the one or more pins is in the unlocked configuration. In some embodiments, the first hinge body may pivot about the hinge pin relative to the second hinge body between a first pivot position and a second pivot position different from the first pivot position, and wherein the one or more pins may be in the locked configuration in both the first pivot position and the second pivot position. In some embodiments, when in the locked configuration in the first pivot position the one of more pins may engage at least one first aperture and at least one second aperture to lock the first hinge body relative to the second hinge body and when in the locked configuration in the second pivot position the one of more pins may engage another first aperture or another second aperture to lock the first hinge body relative to the second hinge body. In various embodiments, when in the locked configuration at least two pins of the one or more pins may engage at least two first apertures of at least one first aperture and at least two second apertures of at least one second aperture.

In some embodiments, a method of locking a portion of a saddle-type window air conditioner in one or more pivot positions relative to a remaining portion of the saddle-type window air conditioner may include providing a hinge lock mechanism between an outdoor portion of the saddle-type window air conditioner and an indoor portion of the saddle-type window air conditioner. In various embodiments, the method may include pivoting the outdoor portion of the saddle-type window air conditioner relative to the indoor portion of the saddle-type window air conditioner between at least one first pivot position and at least one second pivot position via the hinge lock mechanism. In some embodiments, the method may include locking the hinge lock mechanism in at least one of at least one first pivot position and/or at least one second pivot position.

In addition, in some embodiments, locking the hinge lock mechanism may occur in both at least one first pivot position and at least one second pivot position. In various embodiments, the method may include actuating at least one pin and a hinge pin from a locked configuration to an unlocked configuration. In some embodiments, the method may include biasing at least one pin and the hinge pin towards the locked configuration. In various embodiments, the method may include aligning apertures of the hinge lock mechanism when in at least one first pivot position and misaligning the apertures of the hinge lock mechanism between at least one first pivot position and at least one second pivot position. In some embodiments, the method may include engaging one or more pins into the aligned apertures of the hinge lock mechanism when in at least one first pivot position and disengaging the one or more pins from at least one aperture of the misaligned apertures of the hinge lock mechanism between at least one first pivot position and at least one second pivot position. In various embodiments, the method may include unlocking the hinge lock mechanism in at least one of at least one first pivot position and/or at least one second pivot position. In some embodiments, the method may include operating two of the hinge lock mechanisms independently of each other.

These and other advantages and features, which characterize the invention, are set forth in the claims annexed hereto. For a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 8:
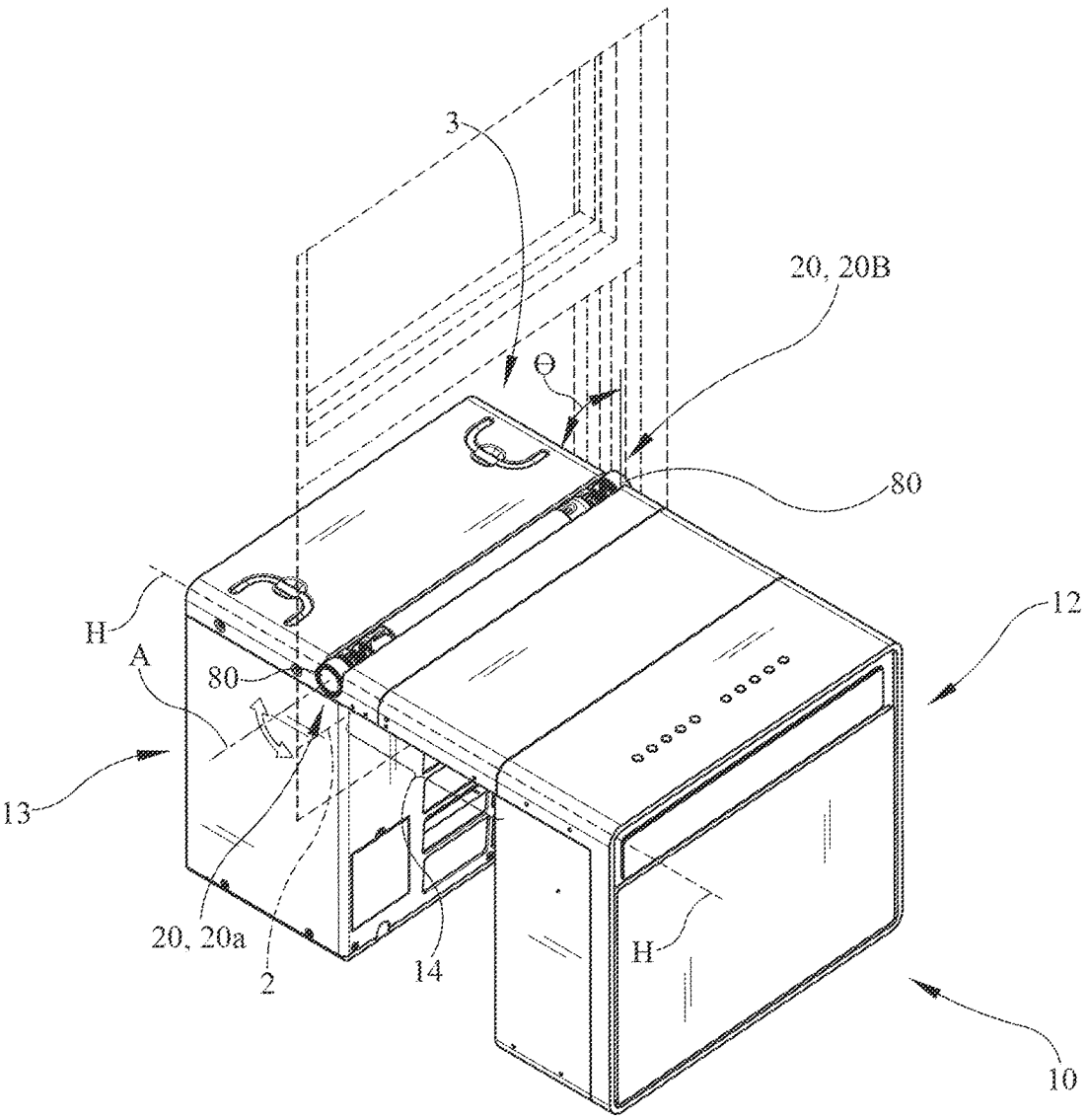
FIG. 8 is a top perspective view from an indoor viewing angle of the embodiment of the saddle-type window air conditioner inserted into the window opening, with the outdoor portion of the saddle-type window air conditioner in a second pivot position and/or installed position.
Figure 9:
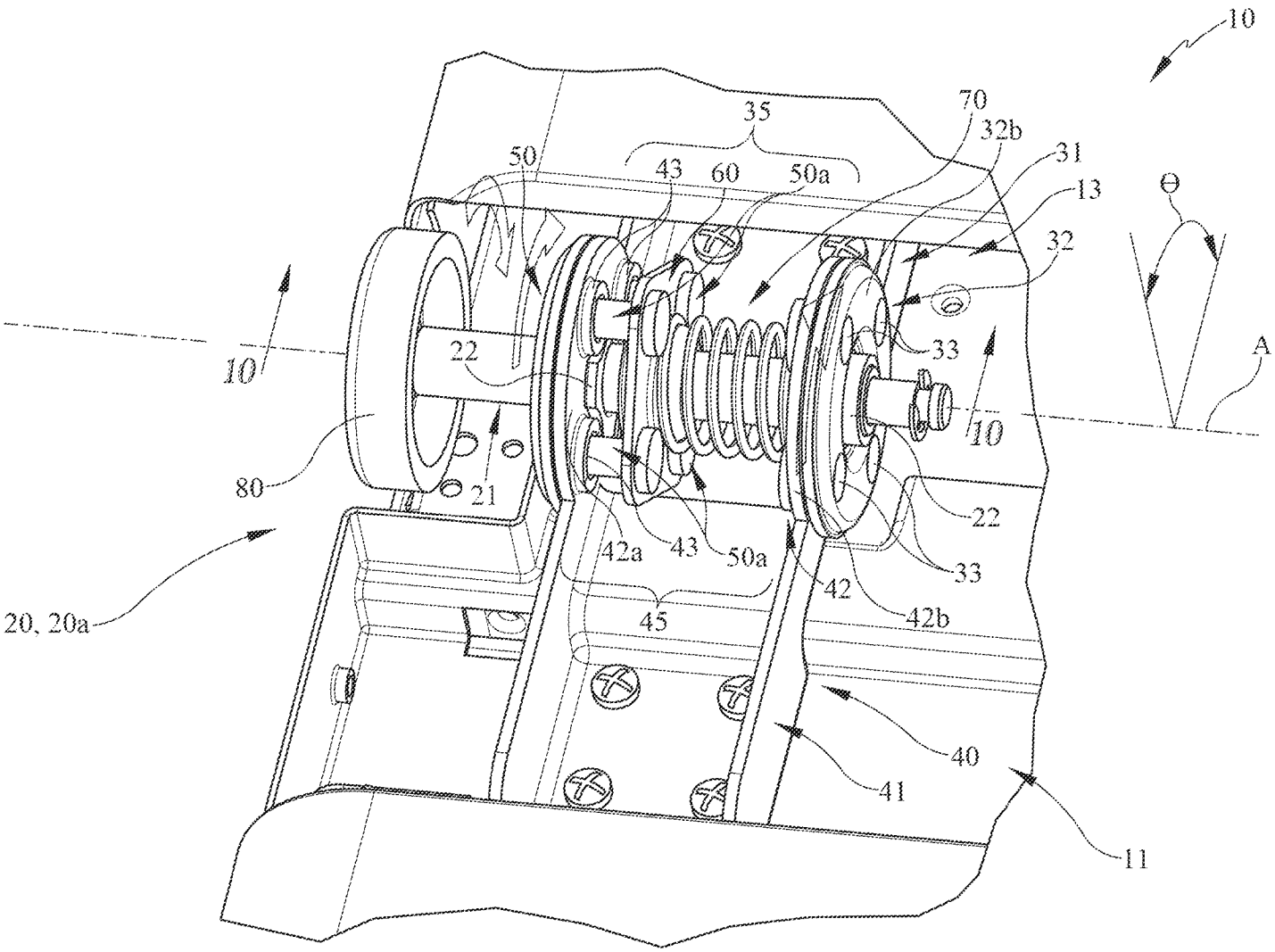
FIG. 9 is a perspective view of one embodiment of the hinge lock mechanism of FIG. 8, illustrating an unlocked configuration in the second pivot position.
Figure 10:
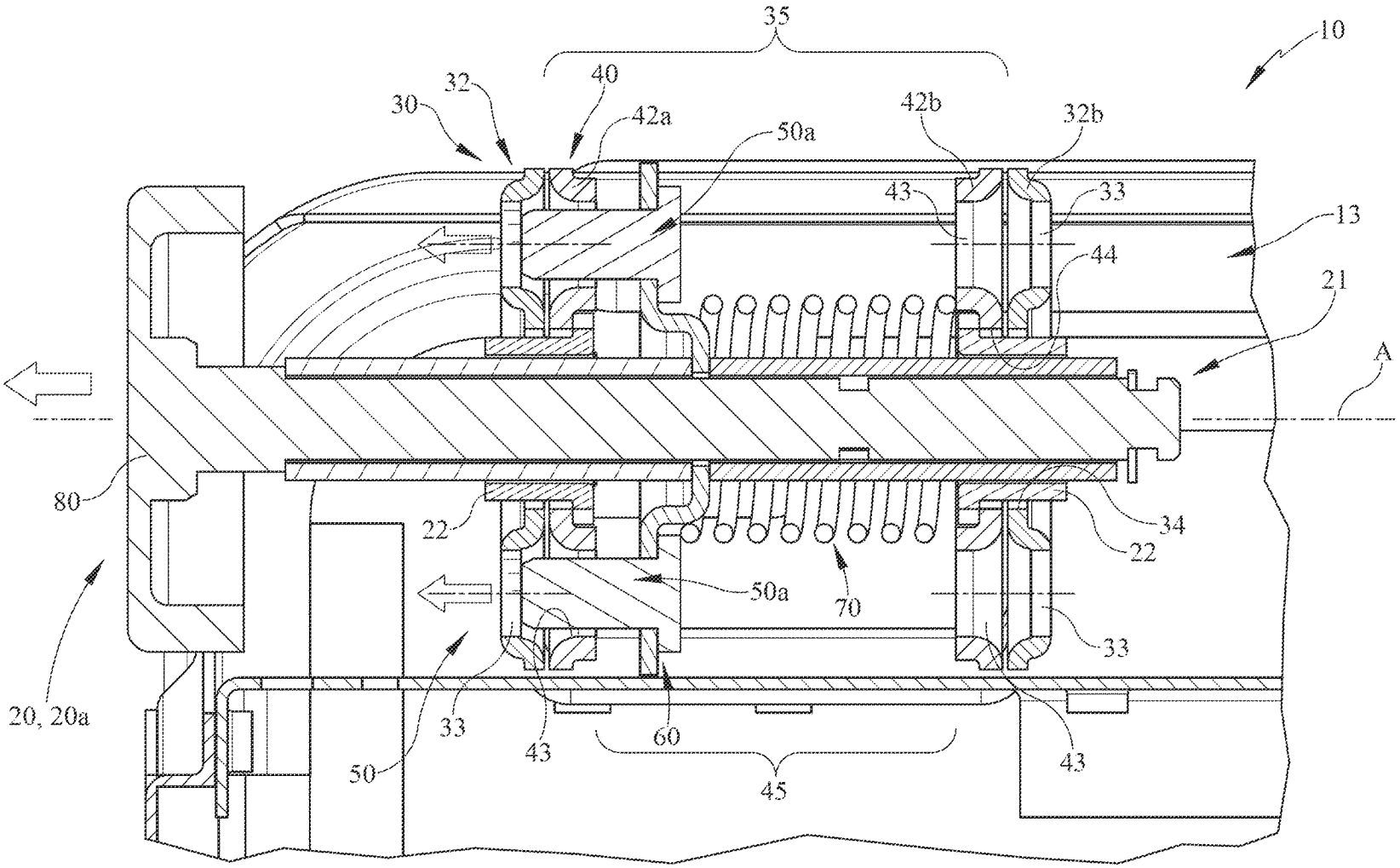
FIG. 10 is a sectional view taken along line 10-10 of FIG. 9.

Turning now to the Figures, wherein like numbers denote like parts throughout the several views, the overall configuration of various embodiments of a hinge lock mechanism for a window A/C unit will be described. In general, the Figures depict one or more hinge lock mechanisms 20 for a window air conditioner 10, wherein the window air conditioner 10 has three primary sections or portions: a connector/bridge 11, an indoor portion 12 and an outdoor portion 13. Together the connector 11, indoor portion 12, and outdoor portion 13 make up a generally inverted U-shaped, or "saddle-type" window air conditioner 10, having an open space/channel 14 between the indoor portion 12 and the outdoor portion 13. The connector 11 may be disposed between the outdoor portion 13 and the indoor portion 12. The open space 14 is bounded at the top by the connector 11 (e.g. bottom surface). In an installed position as shown in FIG. 8, the open space 14 is configured to be place over or receive a window sill 2, such that the indoor portion 12 is situated indoors of and downwardly depending with respect to the window sill 2, and the outdoor portion 13 is situated outdoors of and downwardly depending with respect to the window sill 2. In this manner, the open space 14 can receive the window sill 2 therewithin when the saddle-type window air conditioner 10 is installed in a window opening 3 as shown in the one embodiment in FIG. 8.

Figure 1:
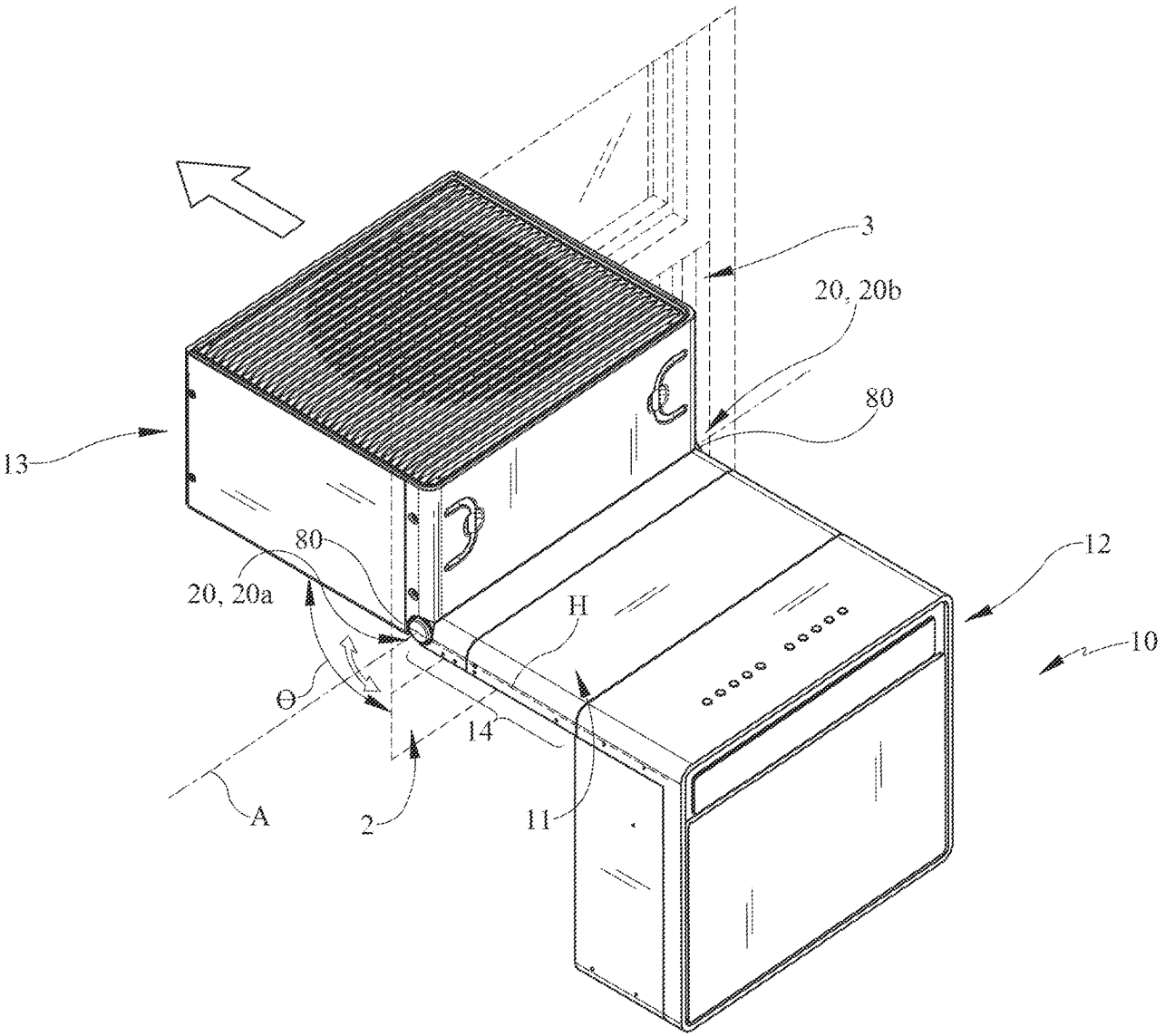
FIG. 1 is a top perspective view from an indoor viewing angle of an embodiment of the saddle-type window air conditioner inserted into the window opening, with the outdoor portion of the saddle-type window air conditioner in a first pivot position and/or installation position, and/or illustrating two hinge lock mechanisms operating independently of each other.

With reference now to FIGS. 1-15, an embodiment of the one or more hinge lock mechanisms 20 is shown. The one or more hinge lock mechanisms 20 hingedly connect/pivot one or more portions (e.g. indoor, outdoor, connector, etc.) of the appliance 10 relative to the remaining portions of the appliance 10. The one or more hinge lock mechanisms 20 hingedly connect/pivot at least the outdoor portion 13 relative to at least one of the indoor portion 12 and/or connector 11, or portions thereof, between a variety of pivot positions in one or more pivot angles θ. Although the one embodiment shows the one or more hinge lock mechanisms 20 (e.g. first hinge lock mechanism 20*a*, second hinge lock mechanism 20*b*) connecting (e.g. directly to, at hinge/pivot axis A) the outdoor portion 13 to the connector 11 (e.g. end adjacent the outdoor portion), the hinge lock mechanism 20 may be in a variety of positions within the window air conditioner 10 and still be within the scope of the invention. For example, the hinge lock mechanism 20 may be positioned between or hingedly connect portions of the connector in some embodiments. The hinge lock mechanism 20 may pivot the outdoor portion 13, or portions thereof, for a variety of angles θ (e.g. first, second, third, etc.) relative to the pivot axis A (e.g. one or more hinge pins 21) from one or more pivot positions/configurations (e.g. first, see FIG. 1) to one or more pivot positions/configurations (e.g. second, different position, see FIG. 8). For example, the outdoor portion 13 may pivot (e.g. 90 degrees, 110 degrees, etc.) about the hinge pin/axis 21, A and/or hinge lock mechanism 20 between at least one first pivot position (see FIG. 1) and at least one second pivot position (see FIG. 8). As shown in the one embodiment in FIG. 1, the first pivot position may be a pre-installed or installation configuration/position. Further as shown in FIG. 8, the second pivot position may be a final or installed configuration/position. There may be a variety of pivot positions between the first and second pivot positions, or further positions available past the first and/or second pivot positions. The angle pivoted between the pivot positions (e.g. locked, unlocked) may be a variety of angles θ. The angle of travel/pivoting of the second portion, or portions thereof, and/or connector, or portions thereof, may be greater than zero and/or about 45 degrees, 65 degrees, 85 degrees, 90 degrees, 100 degrees, 105 degrees, 135 degrees, 180 degrees, etc. between at least two pivot positions. In the one embodiment shown, the outdoor portion 13, or portions thereof, may pivot a pivot angle θ of about 90 degrees between at least one first pivot position and at least one second position. The installation or first pivot position may have the outdoor portion 13 (e.g. top wall) at a 90 degree position relative to the horizontal plane H, connector 11, and/or indoor portion 12. The installed or second pivot position may have the outdoor portion 13 (e.g. top wall) at a 180 degree position relative to the horizontal plane, connector, first pivot position, and/or indoor portion. The outdoor portion may pivot 90 degrees between the installation position and the installed position. The user may pivot the outdoor portion 13 (e.g. about 90 degrees, less than 90 degrees) to the installed or second pivot position relative to the indoor portion 12 and/or connector 11 as shown in FIG. 8 once the saddle-type window air conditioner 10 (e.g. outdoor portion, connector, or portions thereof) passes through the window opening 3 in the installation or first pivot position as shown in FIG. 1. The window air conditioner 10 and/or connector 11 may be positioned on the window sill 2 and/or mount, if used, then pivoted between the first and second pivot positions. Pivoting the outdoor portion 13 to the second pivot position may define the channel 14, or portions thereof, to receive the window sill.

In some implementations, the hinge lock mechanism(s) 20 and/or saddle-type window air conditioner 10 may lock and/or unlock one or more portions of the window air conditioner relative to a remaining portion in one or more positions/angles (e.g. pivot). Locking the relative one or more portions (e.g. hinge bodies, barrels) may not allow pivoting movement of the appliance therebetween. Unlocking the relative one or more portions (e.g. hinge bodies, barrels) may allow pivoting movement of the appliance therebetween. The appliance 10, outdoor portion 13, and/or hinge lock mechanism 20, or one or more portions thereof, may be locked/unlocked in one or more positions (e.g. pivot, first, second, etc.) relative to one or more portions of the appliance 10, hinge lock mechanism 20, indoor portion 12, and/or connector 11. In at least one pivot position, the hinge lock mechanism 20 and/or appliance portion (e.g. outdoor) may be both locked and unlocked. For example, the hinge lock mechanism(s) 20 and/or appliance portion (e.g. outdoor) may be both locked (see FIGS. 11, 12, and 14) and unlocked (see FIGS. 9, 10, and 15) in the installed/second pivot position. Further, for example, the hinge lock mechanism 20 and/or appliance portion (e.g. outdoor) may be both locked (see FIGS. 2 and 3) and unlocked (see FIGS. 4 and 5) in the installation/first pivot position. The appliance 10, hinge lock mechanism 20, and/or outdoor portion 13, or portions thereof, may be unlocked between two pivot positions. In at least one pivot position, the hinge lock mechanism and/or appliance portion (e.g. outdoor) may be unlocked (e.g. see FIGS. 6 and 7, only unlocked). The appliance, hinge lock mechanism, and/or outdoor portion may be unlocked allowing pivoting for one or more pivot angle(s) 0 about the hinge pin 21 or pivot axis A. For example, unlocked to pivot between the installation/first pivot position and the installed/second pivot position.

In some implementations, the saddle-type window air conditioner 10 and/or one or more hinge lock mechanisms 20, or portions thereof, may be configured between a locked configuration and an unlocked configuration. When in the locked configuration as shown in FIGS. 2, 3, 11, 12, and 14, the outdoor portion 13, hinge lock mechanism 20, and/or the appliance 10, or portions thereof, may not pivot in or between one or more positions (e.g. pivot). The hinge lock mechanism 20 (e.g. pin(s) 50*a*, releasable engagement 50, carrier 60, hinge pin 21, actuator 80, linkage 90, bias mechanism 70, hinge body 30, 40 (e.g. first), barrel 32, 42, leaf 31, 41, and/or apertures 33, 43), or portions thereof, may be in the locked configuration when in at least the first pivot position and/or at least the second pivot position. When in the unlocked configuration as shown in FIGS. 4-7, 9, 10, and 15, the outdoor portion 13, hinge lock mechanism 20, and/or the appliance 10, or portions thereof, may pivot relative to a remaining portion of the appliance and/or hinge lock mechanism in and/or between one or more positions (e.g. pivot). The hinge lock mechanism(s) 20 (e.g. pin(s) 50*a*, releasable engagement 50, carrier 60, hinge pin 21, actuator 80, linkage 90, bias mechanism 70, hinge body 30, 40 (e.g. first), barrel 32, 42, leaf 31, 41, and/or apertures 33, 43), or portions thereof, may be in the unlocked configuration in at least the first pivot position, at least the second pivot position, and/or between the first and second pivot positions.

Figure 2:
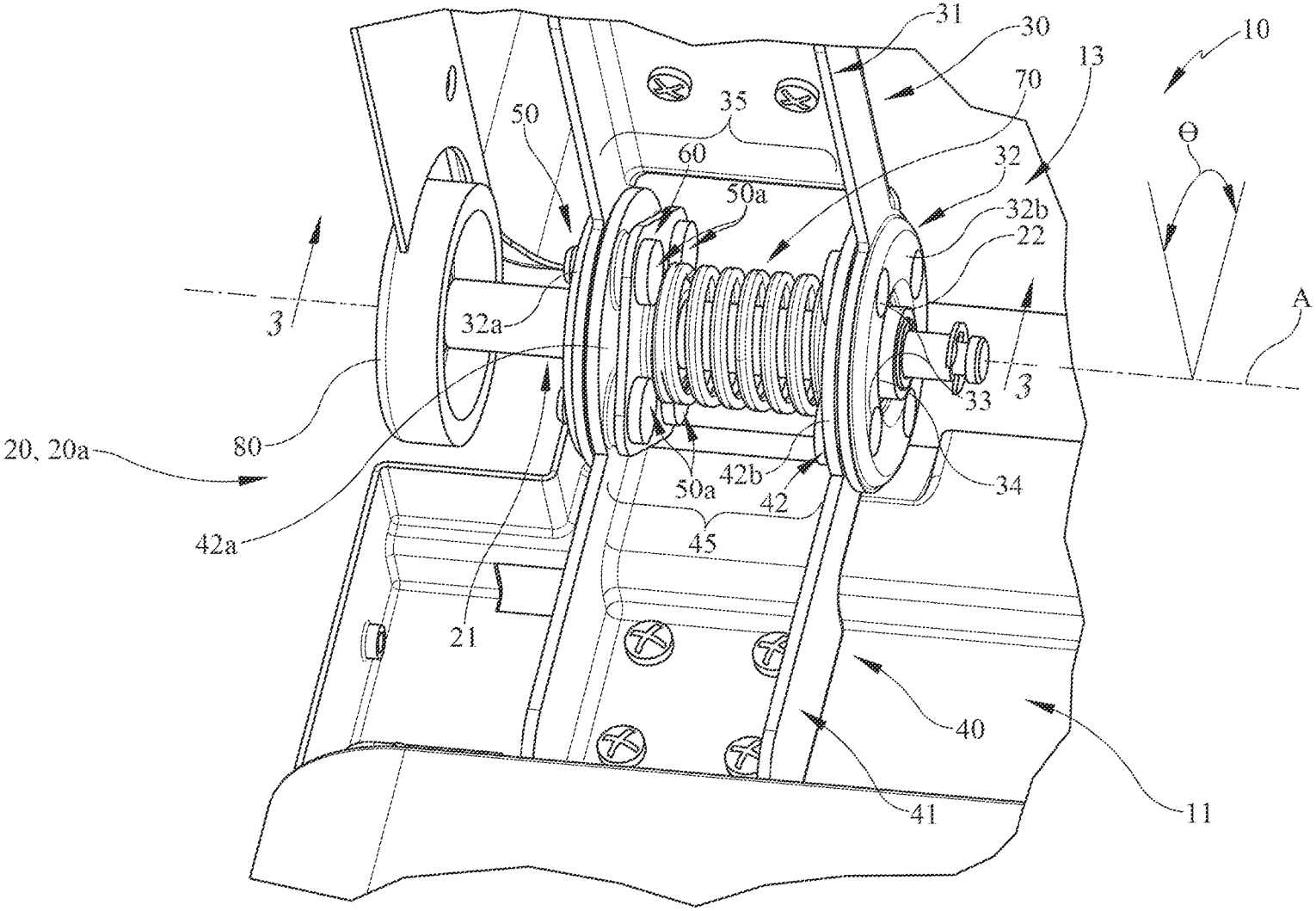
FIG. 2 is a perspective view of one embodiment of the hinge lock mechanism of FIG. 1, illustrating a locked configuration in the first pivot position.
Figure 3:
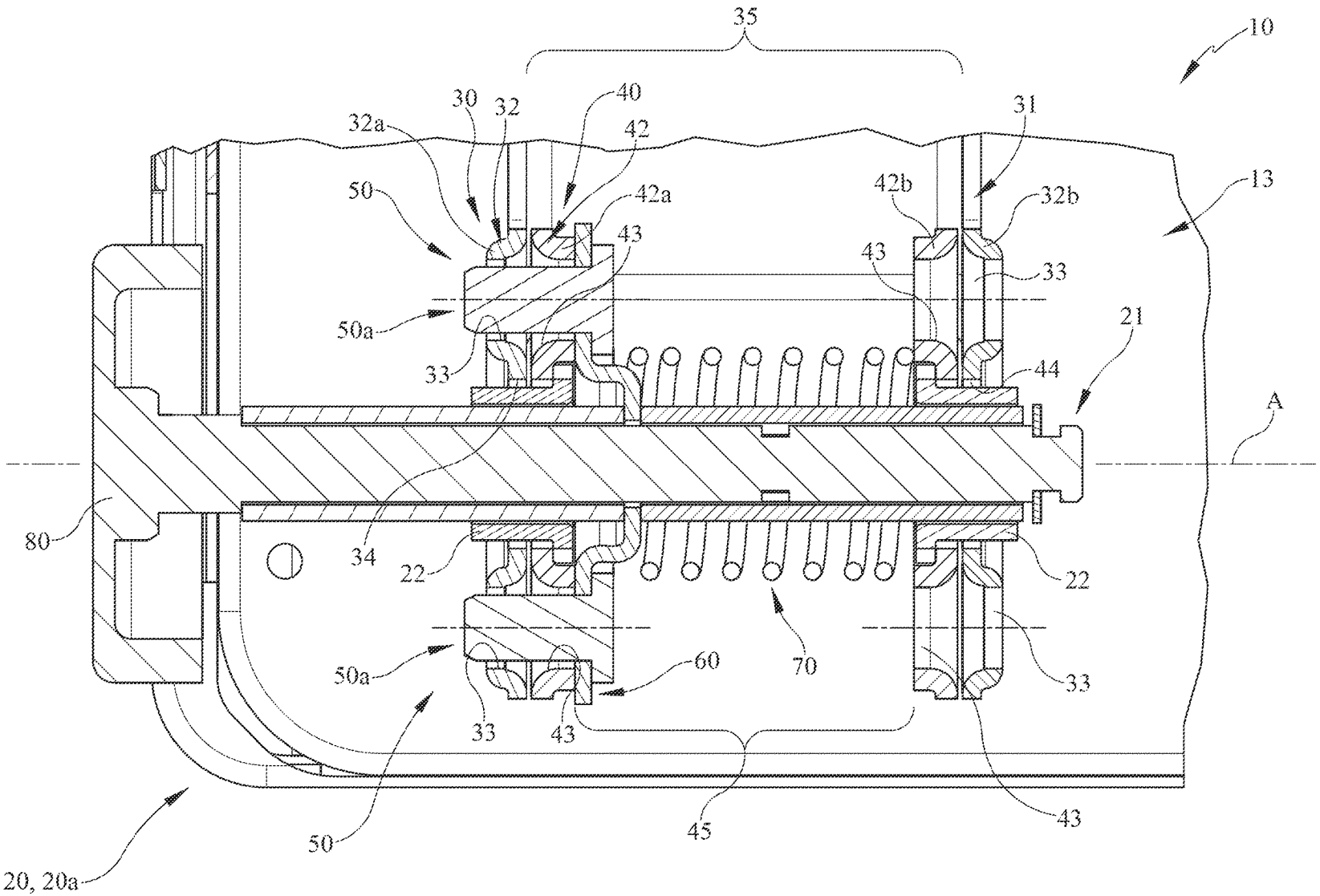
FIG. 3 is a sectional view taken along line 3-3 of FIG. 2.
Figure 4:
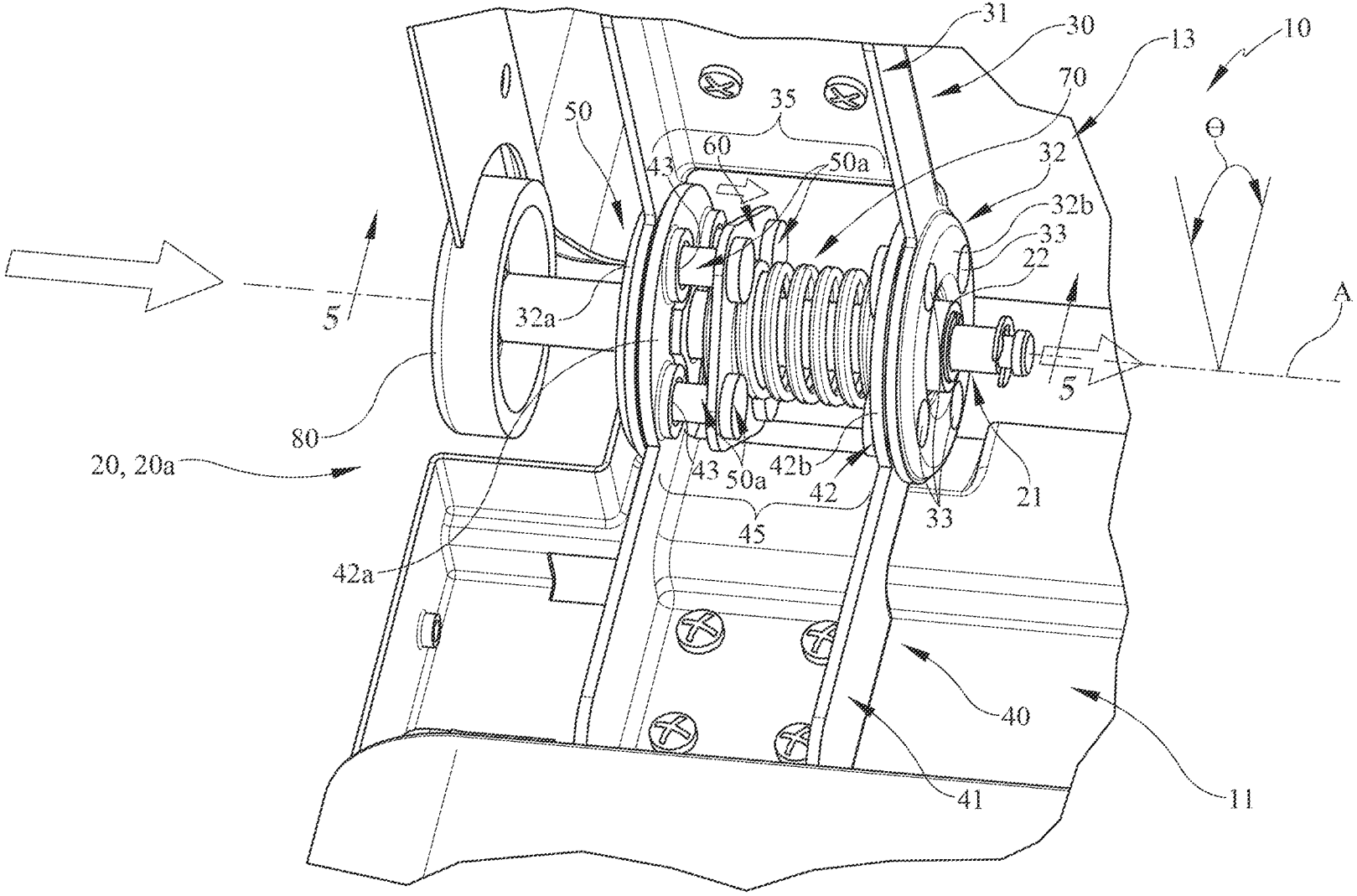
FIG. 4 is a perspective view of the hinge lock mechanism of FIG. 1, illustrating an unlocked configuration in the first pivot position.
Figure 5:
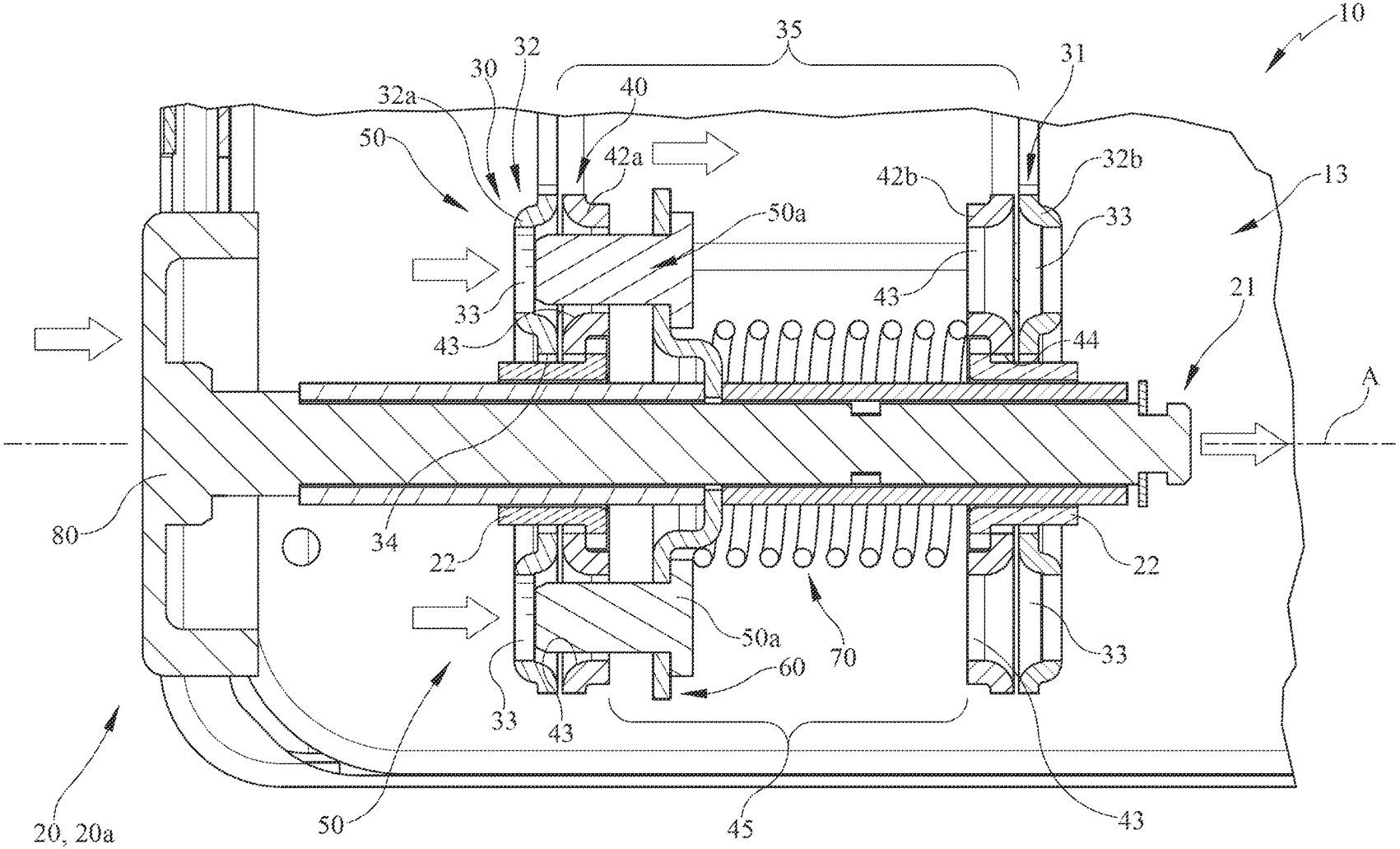
FIG. 5 is a sectional view taken along line 5-5 of FIG. 4.
Figure 6:
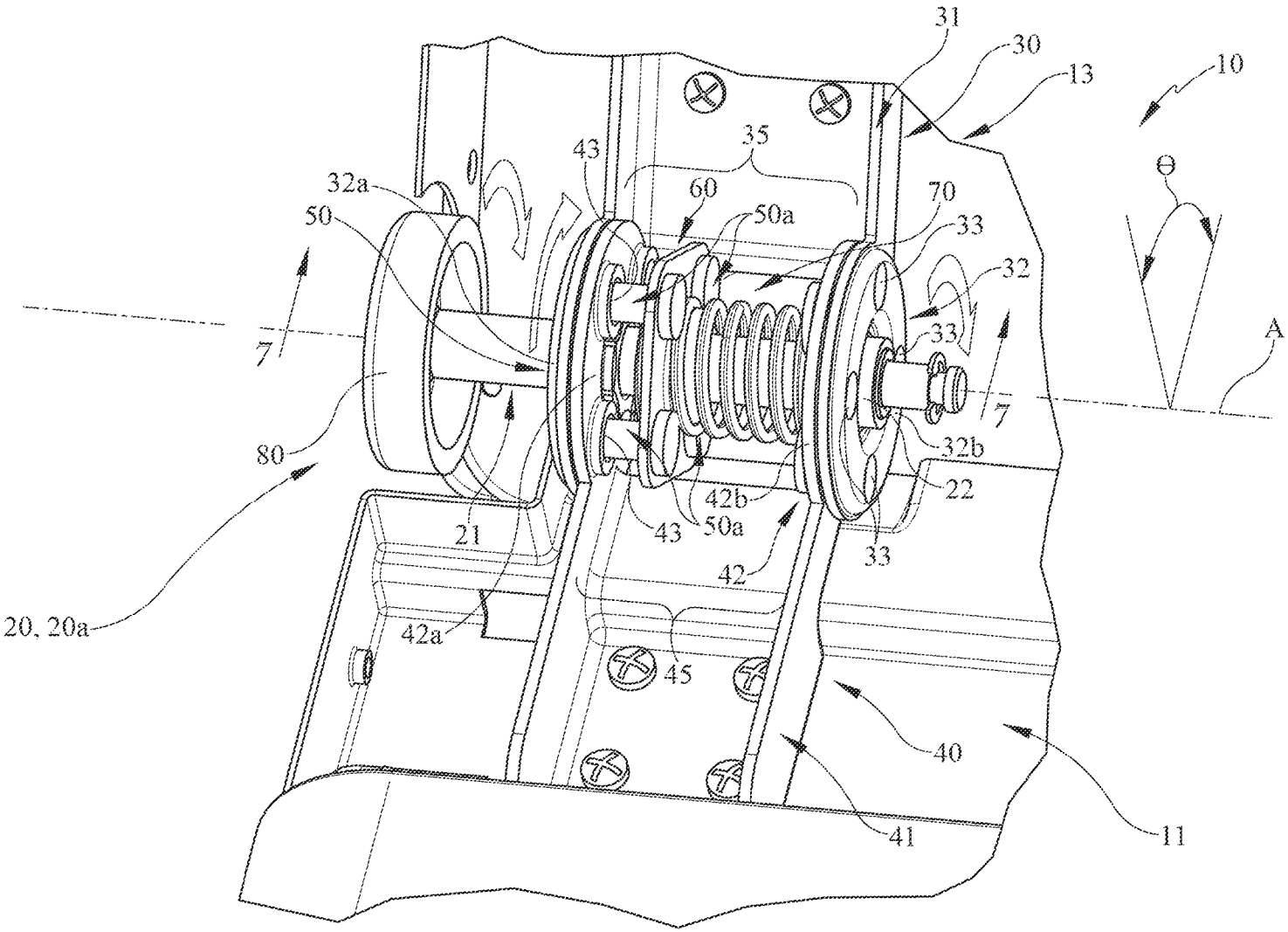
FIG. 6 is a perspective view of the hinge lock mechanism of FIG. 1, illustrating the unlocked configuration in a pivot position between the first pivot position of FIG. 1 and a second pivot position of FIG. 8.
Figure 7:
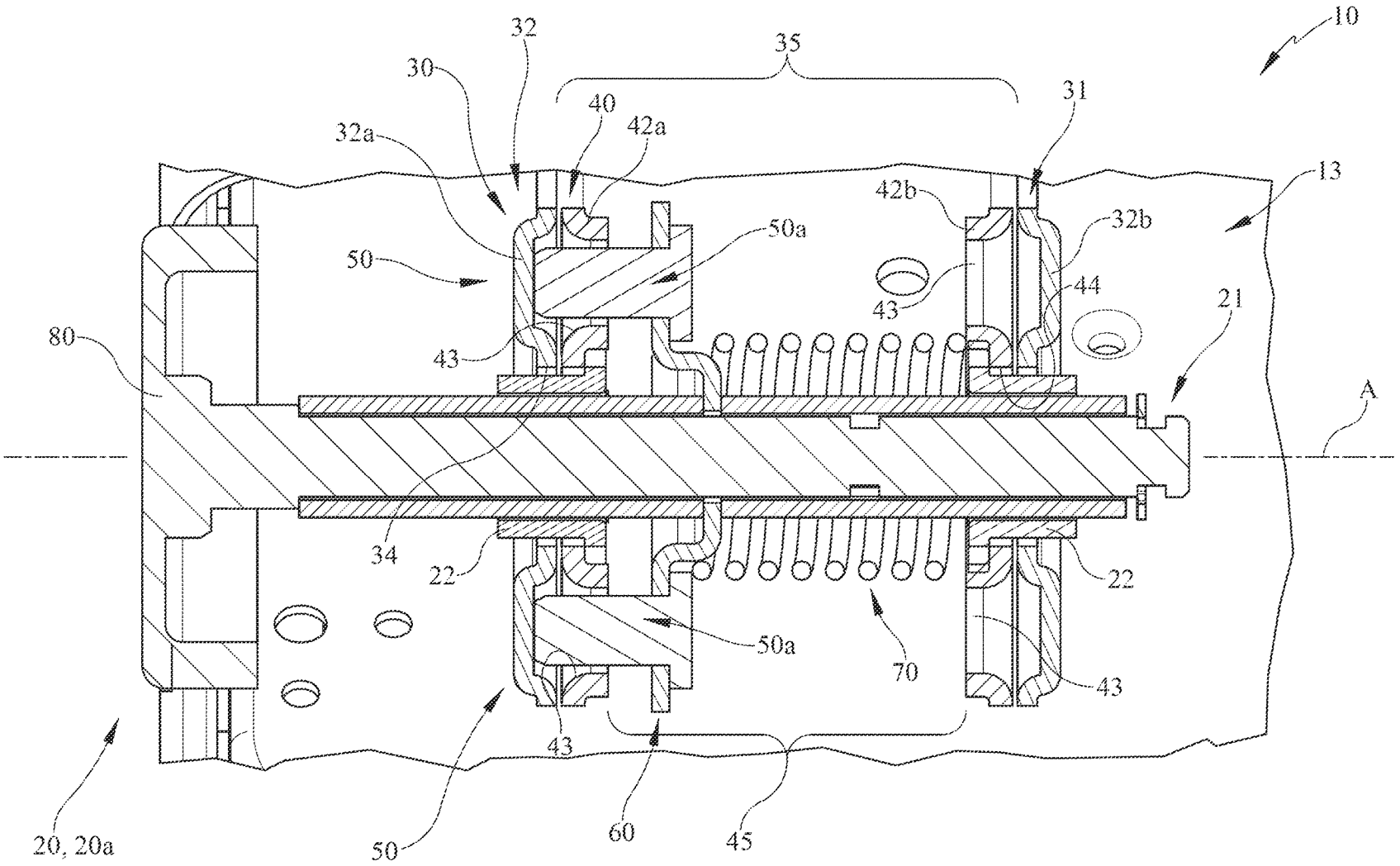
FIG. 7 is a sectional view taken along line 7-7 of FIG. 6.
Figure 11:
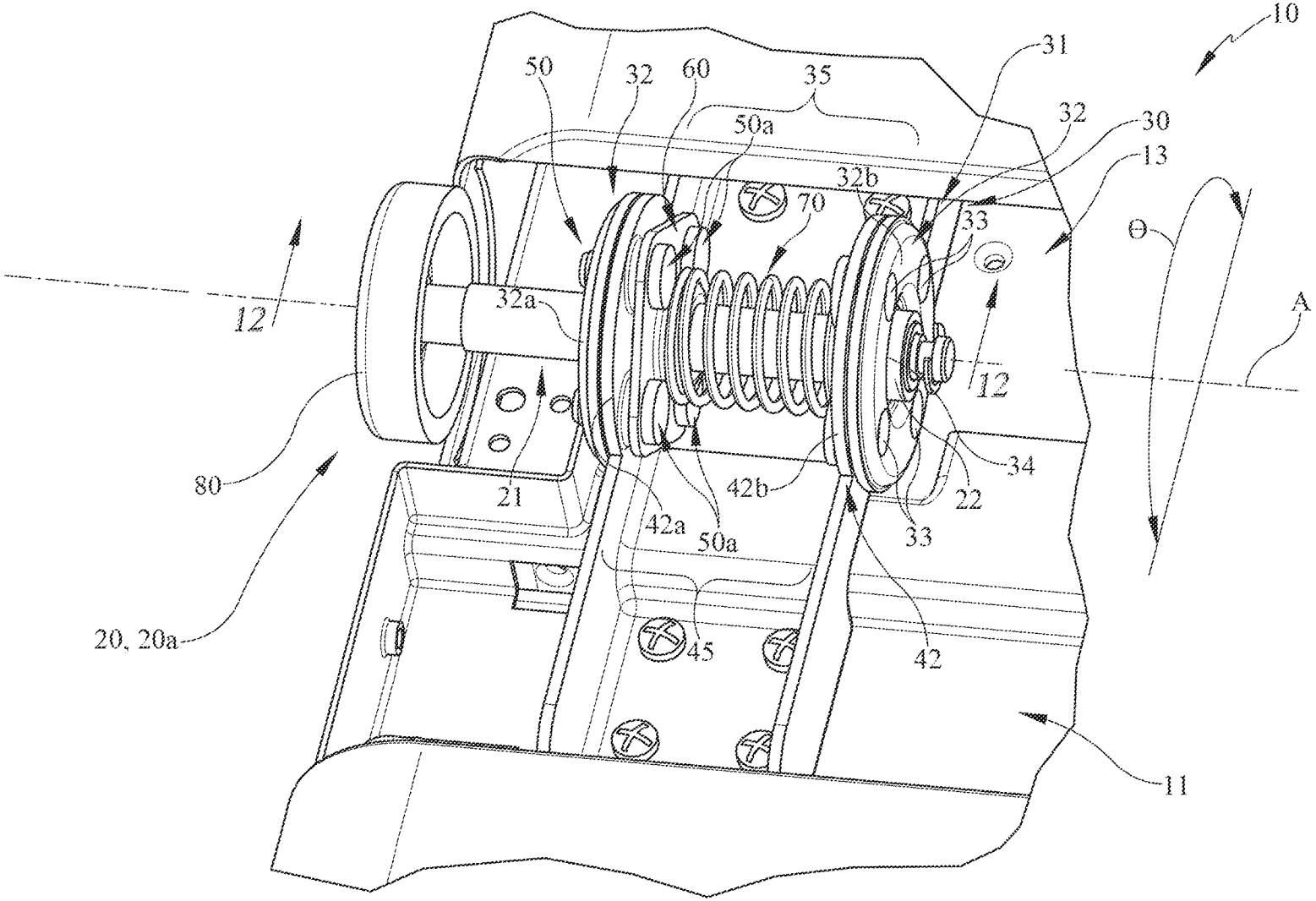
FIG. 11 is a perspective view of the hinge lock mechanism of FIG. 9, illustrating a locked configuration in the second pivot position.
Figure 12:
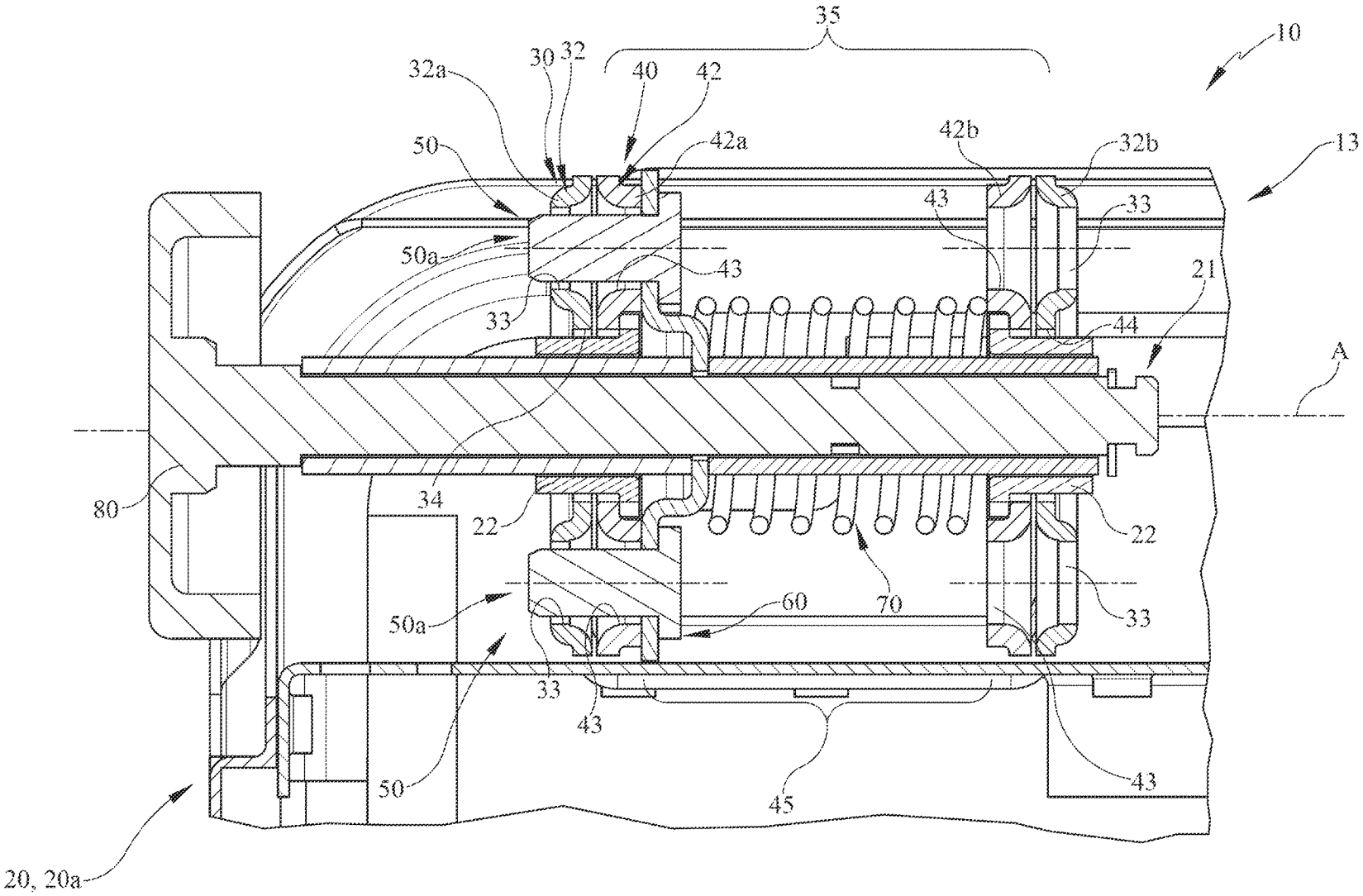
FIG. 12 is a sectional view taken along line 12-12 of FIG. 11.
Figure 13:
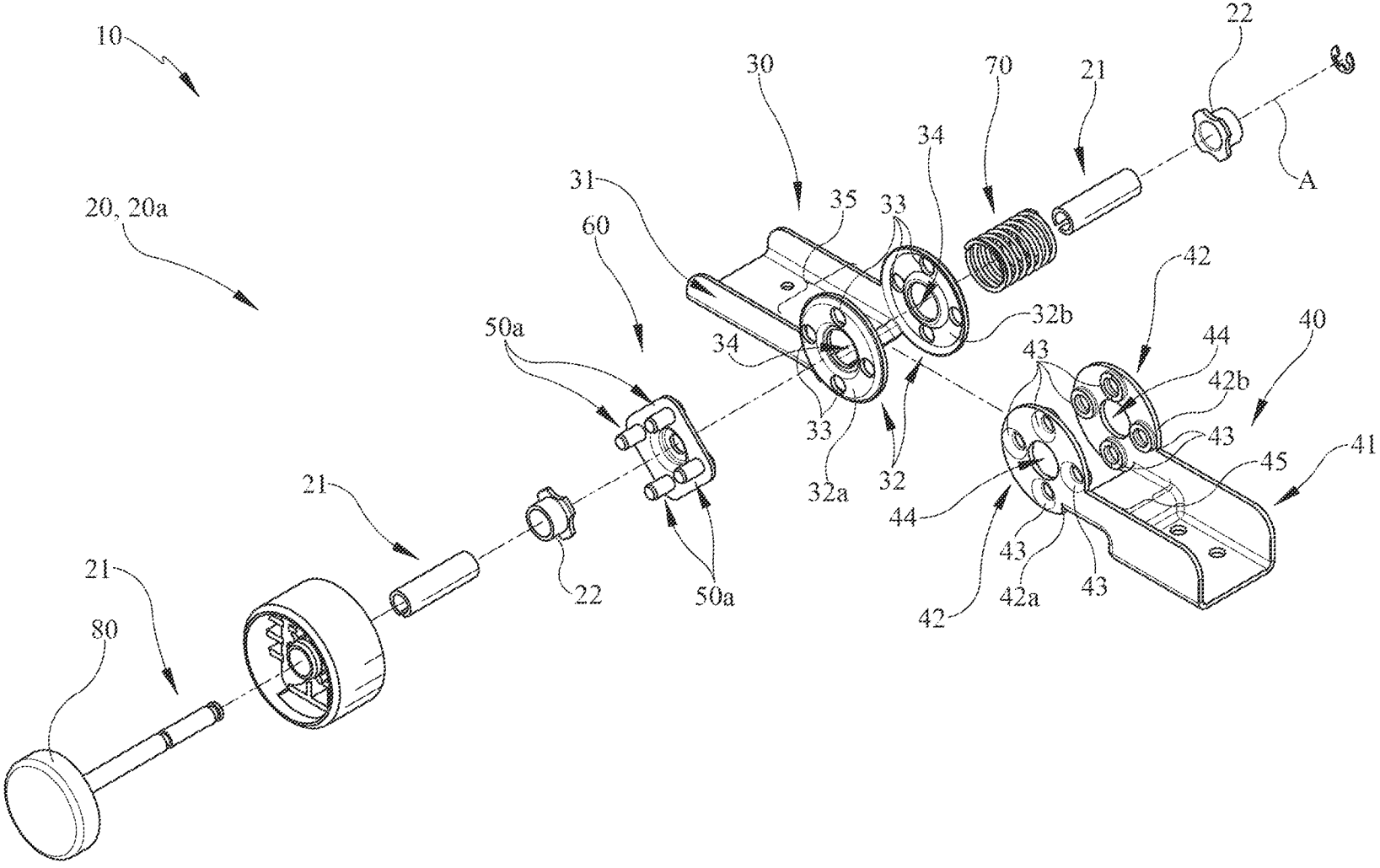
FIG. 13 is an exploded view of the hinge lock mechanism of FIG. 1.
Figure 14:
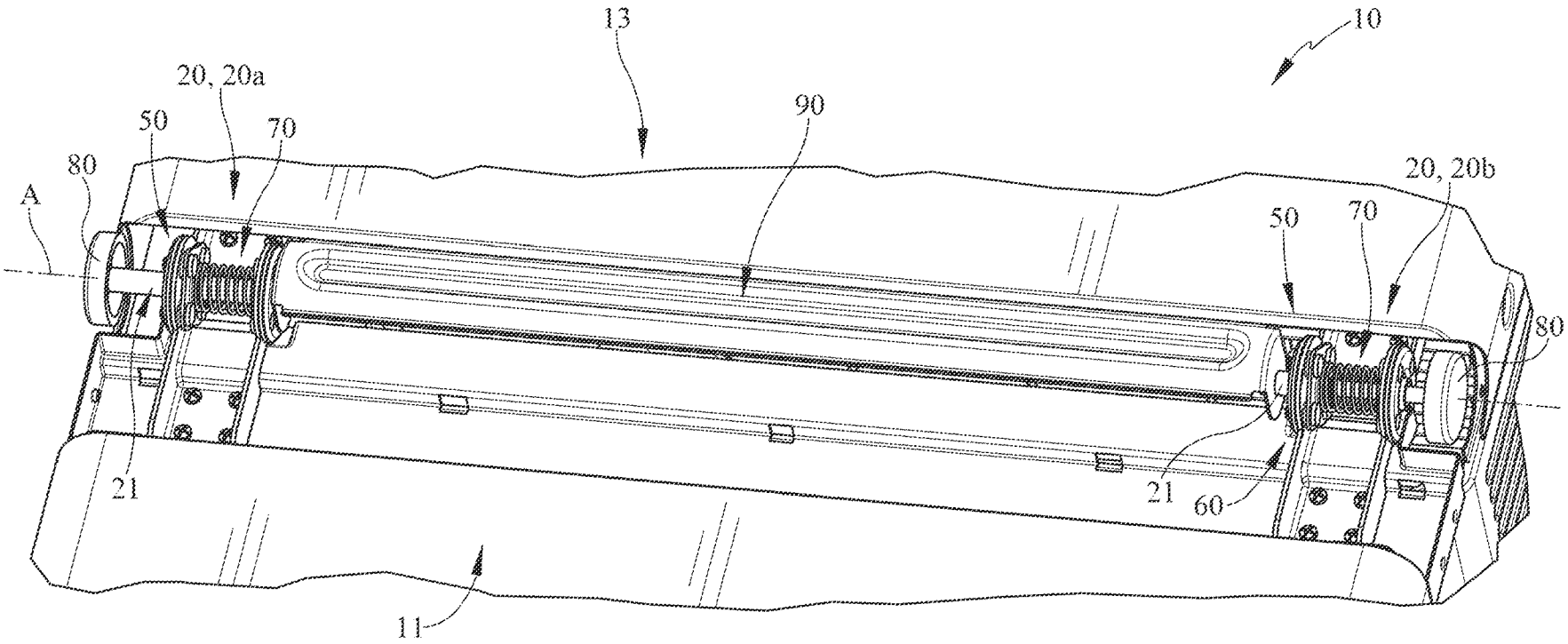
FIG. 14 is a perspective view of two hinge lock mechanisms operated together, illustrating a locked configuration in the second pivot position.

In some implementations, the hinge lock mechanism(s) 20 and/or saddle-type window air conditioner 10 may include one or more pivot/hinge mechanisms. The pivot mechanism may include a first hinge body 30 pivotably connected by at least one hinge pin 21 to a second hinge body 40. The first hinge body 30, or portions thereof, may pivot about the hinge pin 21 or pivot axis A relative to the second hinge body 40. One pivoting portion (e.g. outdoor portion and/or connector) of the appliance may include or pivot with the first hinge body 30. The other pivoting portion (e.g. indoor portion and/or connector) of the appliance may include the second hinge body 40. As shown in the one embodiment, the outdoor portion 13 may include the first hinge body 30. Further, the indoor portion 12 and/or connector 11 may include the second hinge body 40. The hinge body 30, 40 (e.g. first, second) may include a leaf 31, 41 (e.g. first, second) and barrel 32, 42 (e.g. first, second), respectively. The one or more barrels 32, 42 may include one or more apertures or through openings 34, 44, respectively, rotatably/pivotably receiving the hinge pin 21. The one or more barrels 32, 42 may include two opposing plates 32*a*, 32*b* and 42*a*, 42*b* perpendicular to the pivot axis A and connected to the leaf 31, 41, respectively. Each plate 32*a*, 32*b* and 42*a*, 42*b* may include the through opening 34, 44 along/receiving the pivot axis/hinge pin A, 21. A first leaf 31 of the first hinge body 30 may be configured to connect to or be adjacent the outdoor portion 13. The second leaf 41 may be configured to connect to or be adjacent the indoor portion 12 and/or connector 11. The one or more plates 32*a*, 32*b* and 42*a*, 42*b* of the barrels 32, 42 (e.g. first, second) may pivot adjacent to each other. The one or more plates 32*a*, 32*b* and 42*a*, 42*b* of the barrels 32, 42 (e.g. first, second) may be spaced from each other to define a gap 35, 45 (e.g. longitudinal) along the hinge pin 21 or axis A, respectively. The gap 45 between the second plates 42*a*, 42*b* may be smaller than the gap 35 between the first plates 32*a*, 32*b*. The one or more plates 32*a*, 32*b* and 42*a*, 42*b* may be parallel to each other. The opposing first plates 32*a*, 32*b* may be positioned outside the opposing second plates 42*a*, 42*b* along the axis A or hinge pin 21. The plates may be circular in shape having an inner periphery defining the through opening 34, 44 and adjacent the hinge pin 21 and/or an outer periphery having a larger diameter than the inner periphery. In some embodiments as shown, the barrels (e.g. plates, first, second) may include one or more apertures, through openings, releasable engagements, latches, or receptacles 33, 43 (e.g. first, second). The one or more apertures 33, 43 (e.g. first, second) of the barrels 32, 42/plates 32*a*, 32*b*, 42*a*, 42*b* (e.g. first, second) may be radially, outwardly spaced from the through opening 34, 44 and/or peripherally located around the pivot axis A of the hinge pin 21. The axis of the apertures 33, 43 may be parallel to the axis of the through opening 34, 44 and/or axis A/hinge pin 21. The one or more first apertures 33 of the first barrel 32 may be included on one or more of the first plates 32*a*, 32*b*. The one or more second apertures 43 of the second barrel 42 may be included on one or more of the second plates 42*a*, 42*b*. At least one second aperture 43 may axially align with at least one first aperture 33 in at least one pivot position of at least one hinge body/barrel/plate/leaf (e.g. first, second), outdoor portion, indoor portion, connector, and/or portions of the appliance (e.g. locked configuration) as shown in FIGS. 2 and 3. At least one second aperture 43 may axially align with at least another first aperture 33 in at least another or second pivot position of at least one hinge body/barrel/plate/leaf (e.g. first, second), outdoor portion, indoor portion, connector, and/or portions of the appliance (e.g. locked configuration) as shown in FIGS. 11, 12, and 14. At least one second aperture 43 may axially be misaligned with at least another first aperture 33 in at least another/pivot position and/or between the first and second pivot positions of at least one hinge body/barrel/plate/leaf (e.g. first, second), outdoor portion, indoor portion, connector, and/or portions of the appliance (e.g. unlocked configuration) as shown in FIGS. 6 and 7. Further, at least one second aperture 43 may be axially aligned with at least one first aperture 33 when in at least one pivot position (e.g. first, second) and be in both a locked or unlocked configuration as shown in FIGS. 2, 3, 4, 5, 9-12, 14, and 15. The hinge body, plate(s), barrel, leaf, gap, aperture, and/or through openings, if used, may be of a variety of shapes, sizes, quantities, and constructions and still be within the scope of the invention. For example, first apertures and second apertures may be different in angles/spacing therebetween, construction, and/or quantities. Aperture (e.g. first) may not extend through the entire length of plate (e.g. first) as shown in the one embodiment and instead may be a pocket/receptacle. Although both plates (e.g. first, second) are shown as having apertures, it should be understood that that one plate of the barrel may include the aperture(s) in some embodiments. When the apertures of the respective hinge bodies align, one or more pins may releasably engage (e.g. lock, unlock) one or more of the aligned apertures. When the apertures of the respective hinge bodies are misaligned, the one or more pins may be disengaged (e.g. unlocked) from the one or more apertures of one or more barrels allowing pivoting of the hinge lock mechanism/appliance, or portions thereof.

Figure 15:
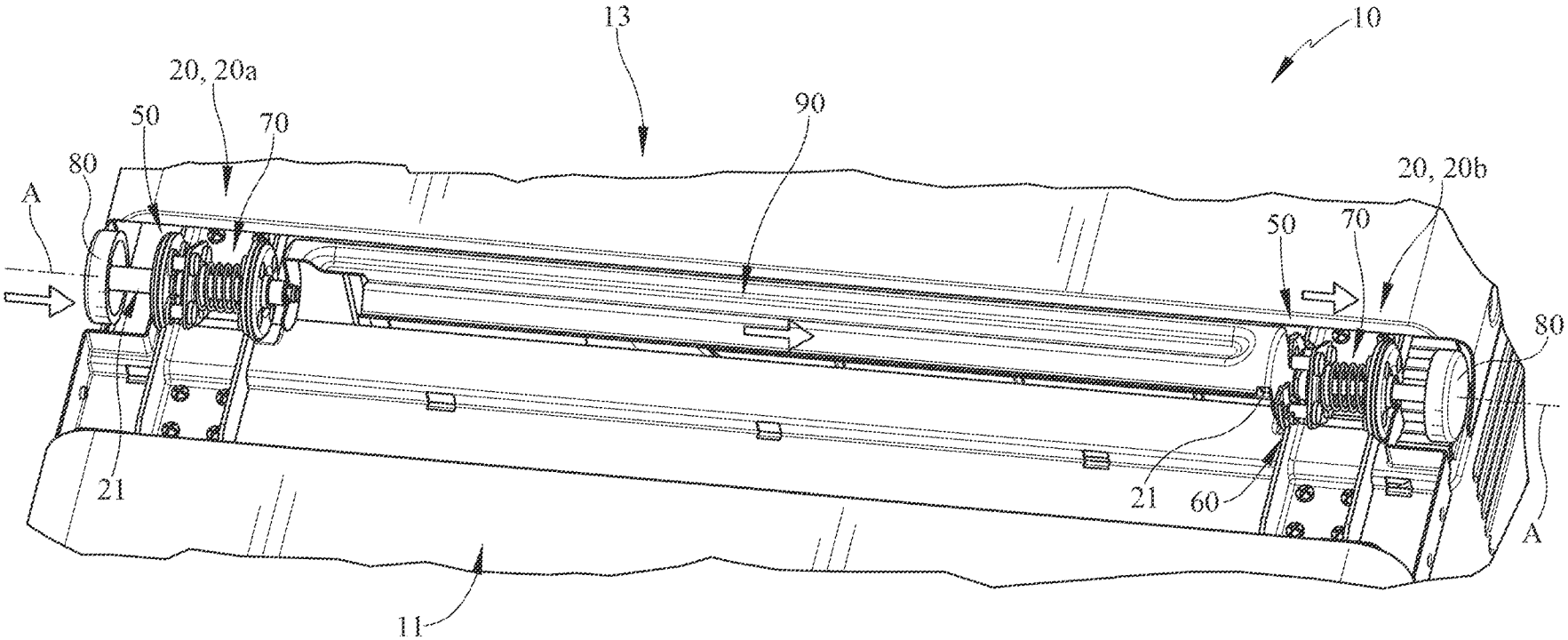
FIG. 15 is a perspective view of two hinge lock mechanisms of FIG. 14, illustrating an unlocked configuration in the second pivot position.

In some implementations, the hinge lock mechanism(s) 20 and/or saddle-type window air conditioner 10 may include one or more releasable engagements 50 (e.g. pin, aperture) configured to releasably engage (e.g. lock and/or unlock) the outdoor portion 13 and/or appliance 10, or portions thereof, (e.g. first hinge body, aperture) relative to the indoor portion 12 and/or appliance 10, or portions thereof (e.g. second hinge body, hinge pin, pins, carrier, bias mechanism, actuator). Although the releasable engagements 50 may be one or more pins/latches/members 50*a* and/or one or more catches/apertures 33, 34 locking/unlocking the position (e.g. pivot) of the first hinge body 30 and/or outdoor portion 13 relative to the second hinge body and/or connector/indoor portion 12, 11, it should be understood that a variety of releasable engagements may be used and still be within the scope of the invention. The one or more pins 50*a* may be positionable between the locked configuration (see FIGS. 2, 3, 11, 12, and 14) and the unlocked configuration (see FIGS. 4-7, 9, 10, and 15). The one or more pins 50*a* may lock the first hinge body 30, or portions thereof, to the second hinge body 40, or portions thereof, when in a locked configuration. The one or more pins 50*a* may unlock the first hinge body 30, or portions thereof, from the second hinge body 40, or portions thereof, when in an unlocked configuration. At least one pin 50*a* may engage at least one aperture 33, 34 of at least one barrel/plate 32*a, b* and 42*a, b* of each hinge body 30, 40 when in the locked configuration. Further, at least one pin 50*a* may be disengaged from at least one aperture 33, 34 of at least one barrel/plate 32*a, b* and 42*a, b* of at least one hinge body 30, 40 when in the unlocked configuration. When in the locked configuration, the one or more pins 50*a* may engage at least one of the first apertures 33 of the first hinge body 30 and at least one of the second apertures 43 of the second hinge body 40 to lock the position (e.g. pivot, first pivot position, second pivot position, etc.) of the first hinge body relative to the second hinge body and corresponding portions of the appliance. The one or more pins 50*a* may be in the locked configuration in one or both of the first pivot position and the second pivot position of the first hinge body 30 relative to the second hinge body 40. The locking of the pivot position and/or releasable engagements of the first hinge body 30 and the second hinge body 40 correspondingly locks the pivot position(s) of the relative portions of the window air conditioner connected thereto. When in the unlocked configuration, the one or more pins 50*a* may be disengaged from at least one of the first apertures 33 of the first hinge body 30 and/or at least one of the second apertures 43 of the second hinge body 40 to unlock the position (e.g. pivot, first pivot position, second pivot position, between the first and second pivot positions, etc.) of the first hinge body 30 relative to the second hinge body 40 and corresponding portions of the appliance. In the one embodiment shown in FIGS. 5, 7, 10, and 15, the one or more pins 50*a* are disengaged from the first aperture(s) 33 of at least one first plate 32*a* or first barrel 32 when in the unlocked configuration. Further for example, when in the unlocked configuration both apertures 33 and 43 of the plates (e.g. 32*a* and 42*a*)/barrels (e.g. 32 and 42) may be disengaged in some embodiments. As shown in FIG. 15, in some embodiments, when in the unlocked position the one or more pins may be disengaged from the second aperture(s) 43 while remaining engaged to the first aperture(s) 33. The unlocking of the pivot position and/or releasable engagements of the first hinge body and the second hinge body correspondingly unlocks the pivot position(s) of the relative portions of the window air conditioner connected thereto. Although the releasable engagement is shown as a pin and/or aperture in the one embodiment, it should be understood that the pin, aperture, or releasable engagement may be a variety of shapes, sizes, quantities, and constructions and still be within the scope of the invention.

In some implementations, when in the locked configuration the hinge lock mechanism 20 and/or pins 50*a* may engage different apertures of the one or more plates/barrels/hinge body to lock the one or more portions of the hinge lock mechanism and/or window air conditioner in different pivot positions. For example, as shown in the one embodiment, when in the locked configuration the one or more pins 50*a* engage a first set of first apertures 33 (e.g. at least one, one, two, three, four) in the first pivot position as shown in FIGS. 2 and 3 and a second set of first apertures 33 (e.g. different, at least one, one, two, three, four) in the second pivot position as shown in FIGS. 11 and 12, different than the first set. Stated alternatively, when in the locked configuration in the first pivot position the one or more pins may engage at least one first aperture and at least one second/different aperture to lock the position of the window air conditioner or hinge lock mechanism (e.g. first hinge body relative to the second hinge body) in the second pivot position. Further, when in the locked configuration in at least another or second pivot position the one or more pins may engage another first aperture and/or another second aperture to lock the position of the window air conditioner or hinge lock mechanism (e.g. first hinge body relative to the second hinge body). For example, in the one embodiment shown, the one or more pins 50*a* (e.g. four) releasably engage a set of four first apertures 33 in the first pivot position and locked configuration and when pivoted to the second pivot position the one or more pins 50*a* (e.g. four) engage an another/different set/combination of the four first apertures 33 previously engaged. The four apertures are 90 degrees apart or spaced (e.g. circumferentially) about the hinge pin 21 or pivot axis A. The pins 50*a* are configured to engage different apertures 33, 43 of the pivoting hinge lock mechanism to define different pivot angles θ. For example, at least one different aperture may be engaged by a different pin to define another pivot angle. Although different first apertures are in engaged in two locked and pivot positions, it should be understood that the same second apertures, if used, may be engaged in two locked and pivot positions. In some embodiments, at least one pin may engage/disengage from at least one aperture of the first hinge body and the second hinge body (e.g. plate(s)). In some embodiments, at least two pins may engage/disengage from at least two apertures of the first hinge body and the second hinge body (e.g. plate(s)). In some embodiments, at least three pins may engage/disengage from at least three apertures of the first hinge body and the second hinge body (e.g. plate(s)). In the one embodiment shown in the figures, at least four pins may engage/disengage from at least four apertures of the first hinge body and/or the second hinge body (e.g. plate(s)). Further, the quantity of pins may be different from the quantity of apertures. Further, in some embodiments, at least one pin may engage/lock an aperture in one pivot position but may not engage/lock an aperture in another pivot position.

In some implementations, the lock mechanism 20, releasable engagement 50, and/or saddle-type window air conditioner 10 may include a carrier 60. The carrier 60 may connect one or more pins 50*a* to each other and/or to the hinge pin 21. The carrier 60, if used, may be a plate or disc. The carrier 60 (e.g. plate) may be fixed (e.g. axially, rotationally) to the hinge pin 21, or one or more portions thereof, (e.g. outer periphery) and/or fix the one or more pins to the hinge pin. Although not shown, the carrier 60 may be unfixed or slidable/rotatable relative to a stationary hinge pin 21. The plate may be perpendicular to the pivot axis A or hinge pin 21. The carrier 60 (e.g. plate) may space (e.g. radially) the one or more pins 50*a* about and/or away from the pivot axis A or hinge pin 21. The one or more pins 50*a* may be rotationally fixed to the hinge pin 21 and/or hinge body (e.g. second) between the locked configuration and the unlocked configuration. When locking or unlocking the pin(s) 50*a* relative to the aperture(s), hinge body/barrel(s), and/or aperture(s) between the locked configuration and the unlocked configuration, the carrier 60, one or more pins 50*a*, and/or hinge pin 21 may slide (e.g. linearly, between two or more longitudinal positions) along the pivot axis A and/or within the gap 35, 45. When locking or unlocking the pin(s) 50*a* relative to the aperture(s) 33, 43, the hinge pin 21 may slide within the through opening 34, 44 of the one or more hinge lock mechanisms/barrels 32, 42 along the hinge axis. In some embodiments as shown, two spaced apart bushings 22 may connect the sliding hinge pin 21 to the one or more pivoting hinge bodies 30, 40 (e.g. first, second, barrel, plate). In some embodiments as shown, the carrier 60 (e.g. plate) may be positioned within the gap 35, 45 or barrel(s) 32, 42, or more specifically between the opposing plates 32*a*, 32*b* and 42*a*, 42*b* of the hinge bodies (e.g. first, second). It should be understood that the carrier, if used, may be a variety of shapes, sizes, quantities, and constructions and still be within the scope of the invention. For example, the carrier may be positioned outside the gap, radially and/or longitudinally, in some embodiments.

In some implementations, the hinge lock mechanism 20 and/or saddle-type window air conditioner 10 may include one or more actuators 80. The actuator 80, or portions thereof, may be used to lock/unlock the hinge lock mechanism(s) 20 and/or releasable engagement(s) 50, or portions thereof, between the locked configuration and the unlocked configuration. The user may use the one or more actuators 80, if used, to position (e.g. at least unlock/disengage) the one or more pins 50*a* out of engagement with the hinge body 30, 40 (e.g. first, second) and/or aperture 33, 34 (e.g. first, second) from the locked configuration to the unlocked configuration. The user may use the one or more actuators to position (e.g. at least lock/engage) the one or more pins 50*a* into engagement with the hinge body 30, 40 (e.g. first, second) and/or aperture 33, 34 (e.g. first second) from the unlocked configuration to the locked configuration. The actuator 80 may position the one or more pins 50*a* from the locked configuration towards the unlocked configuration. The actuator may position the one or more pins 50*a* from the unlocked configuration towards the locked configuration. The actuator may position the one or more pins 50*a* between the unlocked configuration and the locked configuration. As shown in the one embodiment, the actuator 80 may position the one or more pins 50*a* out of engagement with the first hinge body 30 unlocking the first hinge body 30 from the second hinge body 40. The actuator 80 may include a push button connected to the hinge pin 21, carrier 60, and/or one or more pins 50*a*. The actuator 80 may slide/push/carry/pull/actuate the hinge pin 21, carrier 60, and pin(s) 50*a* along the pivot axis A in one or more directions (e.g. first direction, opposing second direction) disengaging/engaging the one or more pins from the one or more apertures (e.g. first, second). It should be understood that the actuator may be of a variety of shapes, sizes, quantities, and constructions and still be within the scope of the invention.

In some implementations, the hinge lock mechanism 20 and/or saddle-type window air conditioner 10 may include one or more bias mechanisms 70. The bias mechanism 70, if used, may urge the releasable engagement 50 (e.g. one or more pins) into or towards the engagement or the locked configuration with the one or more hinge bodies 30, 40 (e.g. aperture(s). As shown in the one embodiment in the figures, the bias mechanism 70 may be one or more springs urging the one or more pins 50*a* from the unlocked configuration towards the locked configuration. The bias mechanism 70 may urge/bias the one or more pins 50*a*, carrier 60, hinge pin 21, and/or actuator 80 from the unlocked configuration towards the locked configuration and/or hinge body locking the first hinge body with the second hinge body. The bias mechanism 70 may urge the one or more pins 50*a* towards the locked configuration. The biasing may be in one or more directions along the pivot axis A. The spring or bias mechanism may be positioned in the one or more gaps 35, 45. The spring or bias mechanism 70 may surround the hinge pin 21. The spring may contact the carrier 60 (e.g. inner facing surface) and/or pins, if used, and one of the barrels (e.g. second, plate, inner facing surface) defining the gap 35, 45. The actuator 80 may be pressed/actuated narrowing the distance (e.g. longitudinal) between the carrier/pin 60, 50*a* and the plate/barrel hinge body. The spring force increases the more the actuator is pressed towards the spring. With the pin 50*a* disengaged from the one or more apertures (e.g. first, second) or in the unlocked configuration when in the first pivot position, the pin may be urged to return back to the same aperture or locked configuration by the bias mechanism. However as shown in FIGS. 6 and 7, upon pivoting of the hinge body (e.g. first, second, barrel, plate) and/or outdoor portion between the first pivot position and the second pivot position in the unlocked configuration, the aperture is misaligned such that the plate or barrel of the hinge body between apertures prevents the pin 50*a* from moving/biasing towards a locked configuration or aperture. Upon further pivoting the biased pin slides along the barrel or plate and subsequently aligns with an adjacent/different aperture whereby the spring urges (e.g. automatically) the one or more pins into another aperture in the second pivot position and locked configuration. The steps of actuating and pivoting the hinge body and/or outdoor portion may return the outdoor portion from the second pivot position to the first pivot position or to a third pivot position that may be another/third locked configuration.

In some implementations, the saddle-type window air conditioner 10 may include one or more hinge lock mechanisms 20 (e.g. first, second, third, etc.). In the embodiments shown, at least two hinge lock mechanisms 20*a* and 20*b* may be used. Alternatively for example, a single hinge lock mechanism may be used. The two or more hinge lock mechanisms 20, 20*b* may be actuated/operated independently of each other to pivot (e.g. unlock, lock) the outdoor portion 13 relative to the indoor portion 12 between the first pivot position and the second pivot position. For example, the one embodiment shown in FIGS. 1-13, illustrates two independently operated hinge lock mechanisms 20*a*, 20*b* on opposing ends of the hinge that are each actuated to unlock/lock. Both actuators 80 would be operated separately by the user. If one hinge lock mechanism is not actuated, the outdoor portion would be unable to pivot or locked relative to the indoor portion. In another embodiment shown in FIGS. 14 and 15, two or more hinge lock mechanisms 20*a*, 20*b* are operated together by at least one of the hinge lock mechanisms 20*a*, 20*b* and/or actuator 80 (e.g. single) to pivot (e.g. unlock, lock) the outdoor portion relative to the indoor portion between the first pivot position and the second pivot position. The two hinge lock mechanisms are interconnected by one or more connectors 90 (e.g. linkages). The linkage(s) interconnects the releasable engagement 50 and/or pin(s) 50*a* from each of the hinge pins 21 of the two hinge lock mechanisms 20*a*, 20*b* such that actuation (e.g. unlocking, locking) of one hinge lock mechanism 20*a*, 20*b* actuates the other hinge lock mechanism 20*a*, 20*b*. As shown in the one embodiment, the linkage may engage the two hinge pins of each hinge lock mechanism and couple the hinge lock mechanisms together for locking/unlocking.

In use, a saddle-type window air conditioner 10 may include one or more hinge lock mechanisms 20. The hinge lock mechanism 20 may be positioned between or pivot the outdoor portion 13 relative to the indoor portion 12. The outdoor portion 13 may pivot relative to the indoor portion 12 between at least one first pivot position and at least one second pivot position via the one or more hinge lock mechanisms 20. The hinge lock mechanism may be locked or have a locked configuration in at least one pivot position (e.g. the first pivot position, the second pivot position, third pivot position). The hinge lock mechanism may be locked or have a locked configuration in both the first pivot position and the second pivot position. The hinge lock mechanism may be unlocked or have an unlocked configuration in the first pivot position, the second pivot position, and/or between the first pivot position and the second pivot position. Two or more hinge lock mechanisms 20 may be actuated together or independently from each other. The user may actuate one or more pins 50*a*, carrier 60, hinge pin 21, bias mechanism 70, actuator 80, and/or releasable engagements 50 from at least the locked configuration towards the unlocked configuration in one or more pivot positions. A bias mechanism 70 (e.g. spring) may urge the pin(s) 50*a*, carrier 60, hinge pin 21, actuator 80, and/or releasable engagement 50 from the unlocked configuration towards the locked configuration in one or more pivot positions. One or more apertures 33, 43 of the hinge lock mechanism 20 or hinge bodies 30, 40 may be aligned when in at least one pivot position (e.g. first, second) and/or both the first pivot position and the second pivot position. One or more of the apertures 33, 43 of the hinge lock mechanism 20 or hinge bodies 30, 40 may be misaligned between at least two pivot positions and/or between the first pivot position and the second pivot position. When in the locked configuration and/or at least one pivot position (e.g. first, second), the one or more pins 50*a* engage aligned aperture(s) 33, 43 of the hinge lock mechanism or at least one plate of each barrel 32, 42. When in the unlocked configuration, between the two pivot positions, and/or between the first pivot position and the second pivot position, the one or more pins 50*a* are disengaged from the unaligned/misaligned aperture(s) of the hinge lock mechanism or at least one plate of each barrel 32, 42. The user may position or pivot the saddle-type window air conditioner 10 in the first pivot position and/or locked configuration to install the conditioner into the window opening. Once in the window opening 3 or on the window sill 2/mount, the user may actuate or unlock the hinge lock mechanism and pivot the conditioner/outdoor portion to the second pivot position or installed/operating position when in the unlocked configuration. The hinge lock mechanism may automatically lock the locking/engagement mechanism in the second pivot position towards the locked configuration. The hinge lock mechanism 20 may be manually locked/unlocked in some embodiments in the one or more pivot positions. If desired, the user may actuate or unlock the hinge lock mechanism and pivot the conditioner/outdoor portion from the second pivot position to the first pivot position. The hinge lock mechanism may automatically lock the hinge lock mechanism in the first pivot position or locked configuration. When in the first pivot position, the user may remove the conditioner from the window opening.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

The invention claimed is:

1. A saddle-type window air conditioner comprising:

an indoor portion;

an outdoor portion;

one or more hinge lock mechanisms hingedly pivoting the outdoor portion relative to the indoor portion between a first pivot position and a second pivot position, wherein the second pivot position is different than the first pivot position; and wherein the one or more hinge lock mechanisms include a locked configuration and an unlock configuration, wherein the one or more hinge lock mechanisms is in the locked configuration in both the first pivot position and the second pivot position and the one or more hinge lock mechanisms is in the unlocked configuration between the first pivot position and the second pivot position.

2. The saddle-type window air conditioner of claim 1 further comprising a connector disposed between the indoor portion and the outdoor portion, wherein the one or more hinge lock mechanisms hingedly pivot the outdoor portion between the first pivot position and the second position relative to the connector and the indoor portion.

3. The saddle-type window air conditioner of claim 1 further comprising at least two of the one or more hinge lock mechanisms.

4. The saddle-type window air conditioner of claim 3 wherein the at least two hinge lock mechanisms are operated independently of each other to pivot the outdoor portion relative to the indoor portion between the first pivot position and the second pivot position.

5. The saddle-type window air conditioner of claim 3 wherein the at least two hinge lock mechanisms are operated together to pivot the outdoor portion relative to the indoor portion between the first pivot position and the second pivot position.

6. The saddle-type window air conditioner of claim 1 wherein the one or more hinge lock mechanisms include one or more pins locking a first hinge body to a second hinge body when in locked configuration and unlocking the first hinge body from the second hinge body when in the unlocked configuration.

7. The saddle-type window air conditioner of claim 6 wherein the one or more hinge lock mechanisms include a carrier connecting the one or more pins to a hinge pin, wherein the hinge pin connects the first hinge body to the second hinge body.

8. The saddle-type window air conditioner of claim 6 wherein the one or more hinge lock mechanisms include an actuator positioning the one or more pins out of engagement with the first hinge body unlocking the first hinge body from the second hinge body.

9. The saddle-type window air conditioner of claim 8 wherein the one or more hinge lock mechanisms include a bias mechanism urging the one or more pins and/or the actuator into engagement with the first hinge body locking the first hinge body with the second hinge body.

10. A saddle-type window air conditioner comprising:

an indoor portion;

an outdoor portion;

a hinge pin;

a first hinge body having a first leaf and a first barrel, wherein the first leaf is configured to connect to the outdoor portion, wherein the first barrel includes at least one first aperture;

a second hinge body having a second leaf and a second barrel, wherein the second leaf is configured to connect to the indoor portion, wherein the second barrel includes at least one second aperture, and wherein the first hinge body pivots about the hinge pin relative to the second hinge body; and one or more pins is positionable between a locked configuration and an unlocked configuration, when in the locked configuration the one of more pins engages the at least one first aperture and the at least one second aperture to lock the position of the first hinge body and the outdoor portion relative to the second hinge body and the indoor portion and when in the unlocked configuration the one or more pins is disengaged from the at least one first aperture and/or the at least one second aperture to unlock the position of the first hinge body and the outdoor portion relative to the second hinge body and the indoor portion.

11. The saddle-type window air conditioner of claim 10 further comprising a bias mechanism, wherein the bias mechanism urges the one or more pins towards the locked configuration.

12. The saddle-type window air conditioner of claim 10 further comprising an actuator, wherein the actuator positions the one or more pins from the locked configuration towards the unlocked configuration.

13. The saddle-type window air conditioner of claim 10 further comprising a carrier connecting the one or more pins to the hinge pin.

14. The saddle-type window air conditioner of claim 10 wherein the at least one first aperture is axially aligned with the at least one second aperture when the one or more pins is in the locked configuration, and wherein the at least one first aperture is axially misaligned with the at least one second aperture when the one or more pins is in the unlocked configuration.

15. The saddle-type window air conditioner of claim 10 wherein when in the locked configuration at least two pins of the one or more pins engages at least two first apertures of the at least one first aperture and at least two second apertures of the at least one second aperture.

16. The saddle-type window air conditioner of claim 10 wherein the first hinge body pivots about the hinge pin relative to the second hinge body between a first pivot position and a second pivot position different from the first pivot position, and wherein the one or more pins is in the locked configuration in both the first pivot position and the second pivot position.

17. The saddle-type window air conditioner of claim 16 wherein when in the locked configuration in the first pivot position the one of more pins engages the at least one first aperture and the at least one second aperture to lock the first hinge body relative to the second hinge body and when in the locked configuration in the second pivot position the one of more pins engages another first aperture or another second aperture to lock the first hinge body relative to the second hinge body.

* * * * *